United States Patent [19]

Iradjpanah

[11] Patent Number: 4,646,919

[45] Date of Patent: Mar. 3, 1987

[54] AROMATIC CAN WITH MEANS FOR PRESERVING THE AROMA

[75] Inventor: Iradj Iradjpanah, Munich, Fed. Rep. of Germany

[73] Assignee: ZIMI Konstruktions- und Produktionsgesellschaft für technisches Know-How GmbH, Munich, Fed. Rep. of Germany

[21] Appl. No.: 774,937

[22] Filed: Sep. 11, 1985

[30] Foreign Application Priority Data

Sep. 14, 1984 [DE] Fed. Rep. of Germany ... 8427192[U]

[51] Int. Cl.[4] ..... B65D 05/26; B65D 25/10

[52] U.S. Cl. ..... 206/525; 206/248; 206/254; 206/255; 222/390; 222/392; 220/93

[58] Field of Search ..... 206/248, 250, 254, 255, 206/817, 525; 220/93; 221/279, 280; 222/390, 392

[56] References Cited

U.S. PATENT DOCUMENTS

| | | | |
|---|---|---|---|
| 654,031 | 7/1900 | Smith | 206/255 |
| 1,181,611 | 5/1916 | Purcell | 206/255 |
| 1,945,141 | 1/1934 | Fenska | 220/93 |
| 1,945,805 | 2/1934 | Fitzgerald | 206/250 |
| 2,190,163 | 2/1940 | Roth | 222/390 |
| 2,281,251 | 4/1942 | Simmons | 220/93 |
| 2,346,087 | 4/1944 | Seratopalos | 206/255 |
| 3,027,052 | 3/1962 | Marraffilo | 222/390 |
| 3,231,139 | 1/1966 | Bovet | 222/392 |

FOREIGN PATENT DOCUMENTS

| | | | |
|---|---|---|---|
| 135974 | 4/1985 | European Pat. Off. . | |
| 7232726 | 11/1972 | Fed. Rep. of Germany . | |
| 489226 | 6/1954 | Italy | 222/390 |

*Primary Examiner*—William Price
*Assistant Examiner*—Brenda J. Ehrhardt

[57] ABSTRACT

A can, particularly a cylindrical can for maintaining aroma comprises a bottom carrying the contents of the can, which bottom is arranged slidably within the can and which bottom is movable by means of pulling means 3, which are attached to a rotatable ring 5 which can be rotated in a plane perpendicular to the direction of movement, wherein the pulling force or tension exerted on the pulling elements 3 by a rotation of the rotatable ring 5 is directionally changed by a means 4 for changing direction into a tension or pulling force in the direction of the movement of the bottom 10.

16 Claims, 4 Drawing Figures

AROMATIC CAN WITH MEANS FOR PRESERVING THE AROMA

The invention relates to a can, and more particularly to a can for aromatic products.

BACKGROUND OF THE INVENTION

Cans of this kind serve for the storage of strongly aroma containing products such as coffee, tea, tobacco or spices. With common utility cans the air space above the products contained in the can, becomes larger and larger with the sequential withdrawal of the products. Thus the air circulation in the air space above the contents caused by temperature differentials between the inner space and the environment increases significantly and thus the aroma of the contents suffers.

To solve this problem cans have been suggested which keep the air volume above the contents of the can as small as possible. U.S. Pat. No. 2,726,012 achieves this by means of a lid which contacts the contents and forms a tight seal with the inner sidewall of the can. The lid is either manually pressed onto the contents or it sinks down by gravity.

The European Patent application No. 135 974 describes a can where a clog attached to the lid which is pressed from above onto the contents of the can. The German utility model No. 72 32 726 shows a can also having a lid sitting on the contents of the can. The contents are withdrawn in the area of the bottom of the can. The lid slides down during withdrawal of the contents.

It is an object of this invention to provide a can for aroma containing materials in which the aroma also on the top layer of the contents is maintained independently of the level of filling of the can, which can also allow the convenient and easy withdrawal of the contents in the usual fashion and which can be produced for a reasonable price.

This problem is solved in accordance with this invention by a can for aroma containing products having a shiftable means for minimizing the air volume above the contents, when said shiftable means is a bottom or support element carrying the contents.

The can in accordance with this invention guarantees that the air volume above the contents can always be maintained as small as possible. Thus, a turbulance or whirling of the air and a resulting withdrawal of aroma materials is prevented.

In a preferred embodiment of this invention the bottom element of the can is height adjustable through a rotation of the lid. For achieving this, pulling means are provided which are attached to a rotatable ring, which is supported for rotation in a plane substantially orthogonal to the direction of movement of the bottom element, so that the tangential pulling force applied by the pulling means is turned into a pulling in the direction of the movement of the bottom elements by a means for changing direction.

A preferred embodiment of the can comprises at least three pulling elements having the same length and being attached to the rotatable ring in an axially offset way, wherein the azimuthal distances between the points of attachement of the pulling elements on the rotatable ring and the corresponding means for changing direction have a different size in order to compensate for the axial offset.

In a yet further preferred embodiment of this invention the bottom element is both movable upwardly by means of upper means for rotation and pulling and is movable downwardly by means of lower elements for rotation and pulling. In accordance with a still further preferred embodiment the bottom element of the can is provided with a sealing means, which are preferably directed upwardly and which contacts the inner wall of the can when subjected to a load from above.

In a still further preferred embodiment of the can, the internal diamenter of the space, for receiving the contents converges (inwardly) in its upper section or upper end, in order to bring the upper layers of the contents to the center and thus prevent a caking of the contents in the corners during the upward movement of the bottom element.

The lid of the can can be used for actuating the rotatable ring. For that purpose the lid preferably is provided with two gripping elements or connector means, which cooperate with corresponding complementary pieces in the rotatable ring and which at the same time define the regular position of the lid relative to the rotatable ring. The gripping elements or connector elements and the corresponding complementary elements can be arranged so that the rotatable ring can be rotated via the lid only in one direction. The gripping elements or connector elements can be provided with overload safety means which are activated before a rotational momentum is applied to the rotatable ring, which would place excessive strain on the pulling means.

In a still further preferred embodiment the can is provided with display means showing the level of filling of the can, these level means in particular comprise an indicator attached to the lid and a marking applied to the outside of the can. The angular and axial position of the rotatable ring can be fixed by appropriate fixing means cooperating with counterparts in the wall of the can.

In a yet further preferred embodiment the lower end or bottom end of the can comprises an air opening to facilitate the lowering of the movable bottom element, which is necessary before reloading or refilling the can.

The can in accordance with a yet further preferred embodiment of the invention is provided with guiding notches or grooves for the pulling means.

The pulling means in a preferred embodiment of the can are made out of plastic threads, which on both ends have a first area of increased cross-section and at the end of the first area of increased cross-section have a second area of increased cross-section.

The lid of the can comprises in a further preferred embodiment of the invention a plane or flate area which reaches all the way to the contents of the can. This plane or planar area preferably is either a fill element or is shaped into the lid as a cup-like recess.

The lid in accordance with a yet further preferred embodiment of the invention is provided with a ram reaching passed the outside of the can and having slots, said lid being held on the can by spring force. The lid in this embodiment can be readily turned and can be removed by simply pulling.

Further advantages, the features and applications of the invention will become apparent to those skilled in the art from the following description of a specific example and embodiment of the invention in conjunction with the appended claims.

Figure 1:
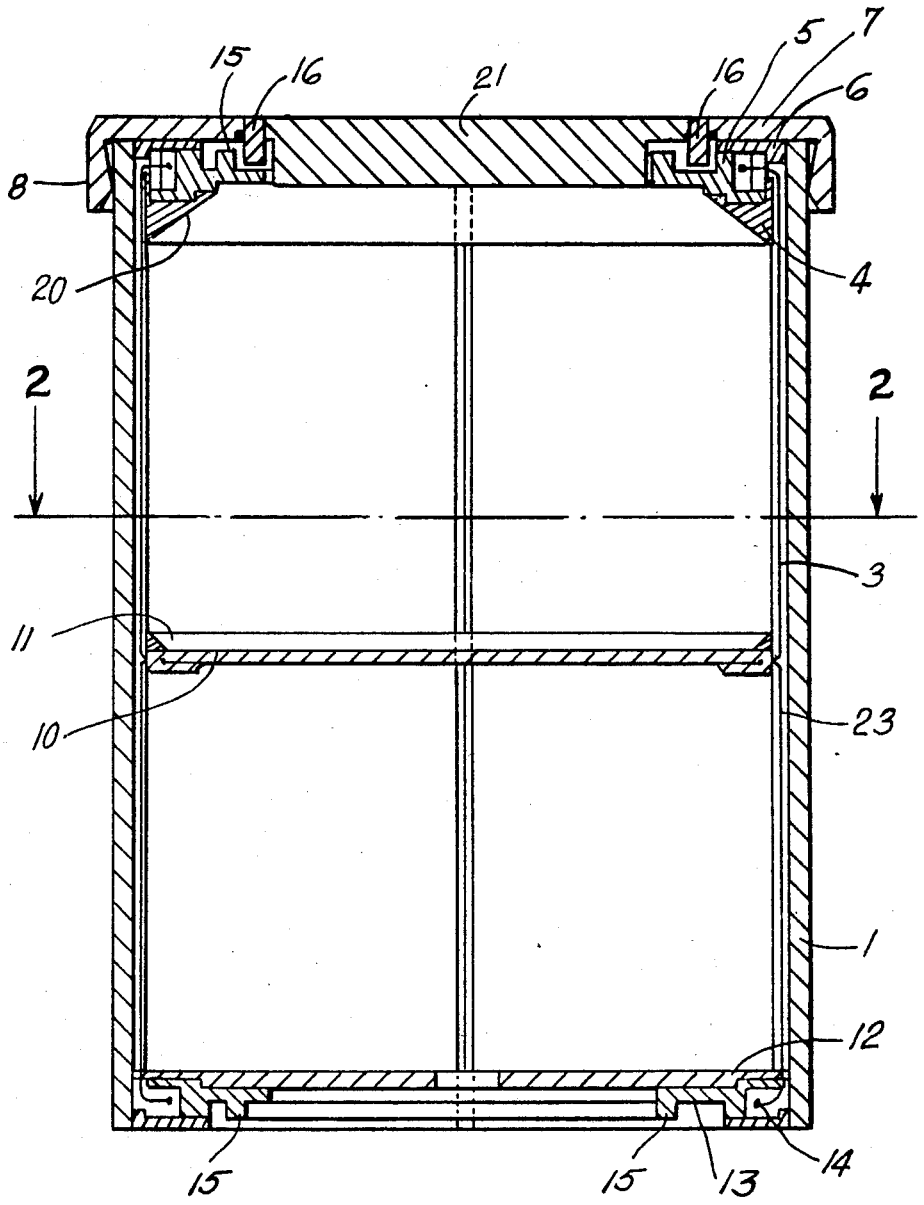
FIG. 1 shows a cross-section through the can.

The can in FIG. 1 comprises a hollow cylinder 1 which is open on both ends, and in which there is arranged a bottom 10. This bottom is preferably built and constructed as a piston. The bottom is provided with an upwardly directed sealing lip 11 which contacts the inside of the can wall 1.

The sealing lip 11 is pressed onto the can wall 1 both by its own elasticity and by the weight of the contents in the can.

Figure 2:
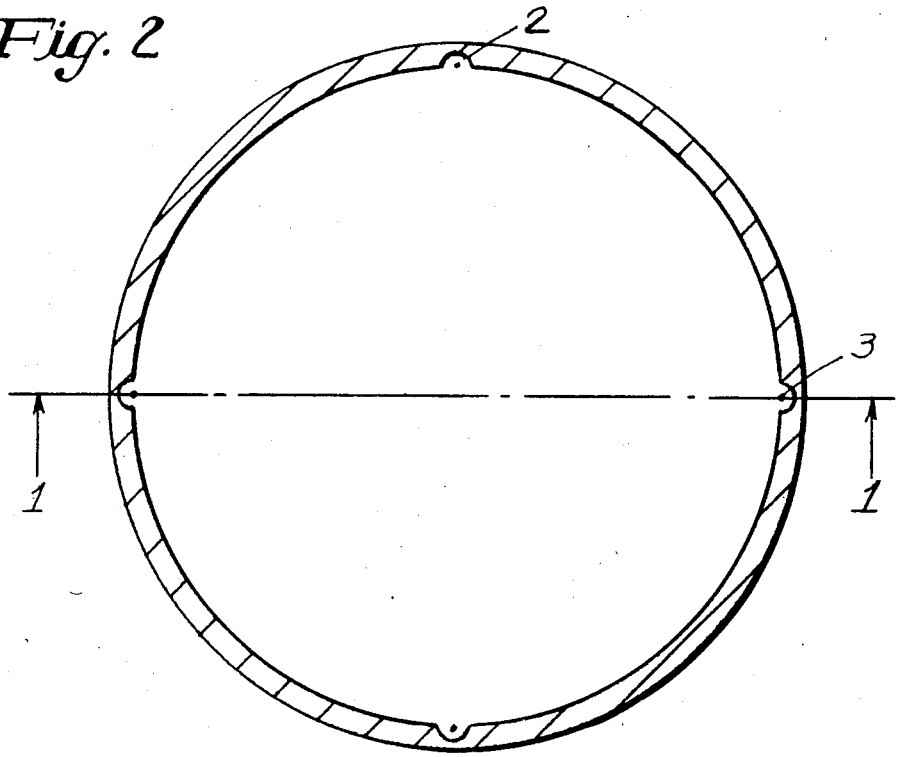
FIG. 2 shows a cross-section along line BB in FIG. 1.

The bottom can is moved by means of pulling elements 3 which are guided in slots 2 (FIG. 2) in the can wall 1. The pulling means can for instance be plastic threads having on both ends a first area of increased cross-section and that the end of the first area of increased cross-section a second area of further increased cross-section. This allows an easy attachment of the threads to the bottom during the assembly which bottom is provided for this attachment for instance with a protrusion having a slot, the width of which corresponds to the central portion of the plastic thread, and which has as its lower end a hole having a diameter which is approximately equal to that of the first area of the increased cross-section of the plastic thread. By these means and arrangement the plastic thread can be readily attached.

In the upper end of the can there is a stationary ring 4 in which a movable or floating rotatable ring 5 is arranged for rotation in a plane perpendicular to the direction of movement of the bottom. The pulling means 3 passed through slots in the stationary ring 4 and are attached to the rotatable ring 5. The stationary ring 4 thus functions as means for changing direction of the pulling means 3. By a rotation of the rotatable ring 5 the pulling means 3 are wrapped onto this rotatable ring 5. By the stationary ring 4 serving as an element for changing directions, the tangential tension to which the pulling means are subjected during the rotation of the rotatable ring 5, is converted into an axial tension, so that the bottom 10 is axially moved or displaced. A cover ring 6 is provided in order to prevent an inadvertent escape of the pulling means 3 from the rotatable ring 5. The stationary ring 4 is provided with a tapered area 20 on the side facing the bottom, whereby the internal diameter of the space receiving the contents is reduced. Thus the contents during the upward movement of the bottom is pressed toward the inside at the upper end of the can and no contents can attach itself in the upper corner or rim of the can.

At the lower end of the can lower pulling means, similar to the upper pulling means are provided. A lower cover ring 14, which is preferably shaped identically to the upper cover ring 6, a lower rotatable ring 13, which is preferably of identical shape with the upper rotatable ring 5, and a lower stationary ring 12, which corresponds to the upper stationary ring 4 and which also has the function of changing pulling directions, which however does not have to have the tapered area of the upper stationary ring 4, are provided.

The stationary rings 4,12 can be maintained by appropriate fixing means or connecting means, such as slots and noses in their angular and axial position relative to the can wall.

In order to simplify the assembly it is prefered to use pulling means 3 which all have the same length. However, if all pulling means are attached in the same axial elevation to the rotatable ring 5 or respectively 13, undesirable entanglement of or interference between the pulling means during the rotation of the rotatable ring 5 or respectively 13 may occure, because a plurality of layers of pulling means 3 can built up on top of each other. For this reason it is advantageous to attach the pulling means in different axial hights to the rotatable rings. In order to avoid a tilting of the bottom 10 during the pulling, i.e. in order to maintain the bottom 10 in a plane perpendicular to the longitudinal axis of the can, the axial shifting in this case has to be compensated. This is preferably done by arranging the attachment point 17 for the pulling means azimuthally shifted on the circumference of the rotatable ring in such a way that the axial offset is being compensated. If the bottom 10 is in its lowest position the point 17 for attaching the pulling means 3, which is attached at the upper most location to the rotatable ring 5, is opposite the corresponding slot in the solid ring 4. The point 17 of attachment for the other pulling means 3 which are attached to the rotatable ring 5 at locations further down, are arranged in the direction of rotation spaced apart from the corresponding slot in the stationary ring 4 by a distance, which compensates the axial offset.

Figure 3:
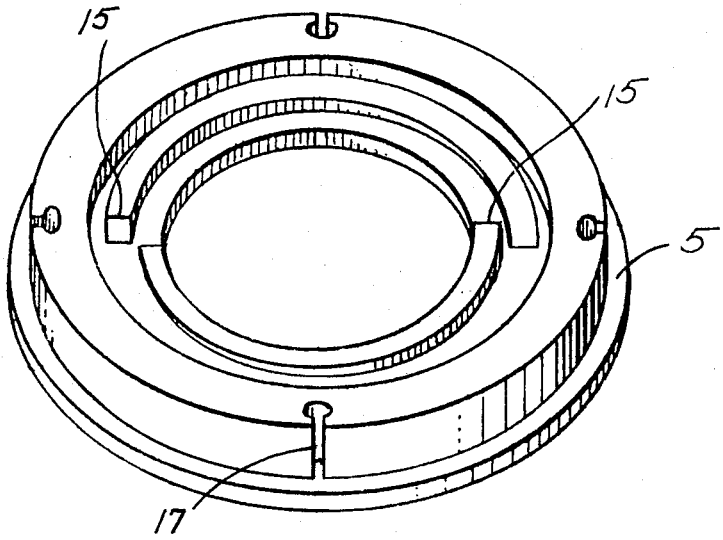
FIG. 3 shows a view of the rotatable to ring to which the pulling means are attached and, FIG. 4 shows a view of the outside of the can.
Figure 4:
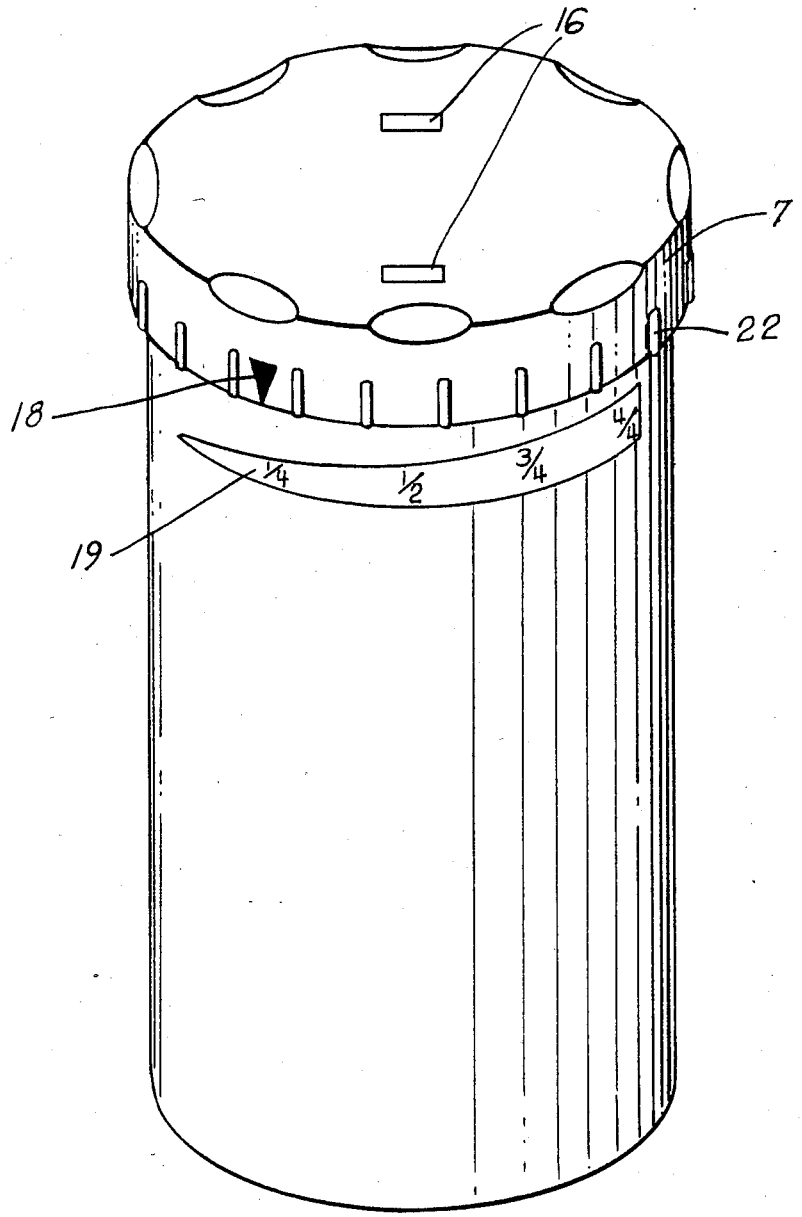

The rotatable ring 5 can be moved by means of a can lid 7. For this purpose the can lid is provided with coupling means 16 or connector means 16 cooperating with corresponding counterparts or counterelements 15 of the rotatable ring 5. These counterelements 15 (FIG. 3) are protrusions with steep front areas and shallowly descending back ends, so that the rotatable ring can be rotated through the lid 7 only in one direction. The counterelements 15 in this embodiment can also be described as curved shallow ramps with steep ends. If the lid is turned into the opposite direction the connector elements or gripping elements 16 in the lid do not find a resistance but slide on the shallowly descending end of the protrusions upwardly. The connector elements or gripping means 16 in the lid preferably comprise overload safety means which are activated through lid 7 before a rotational momentum is exerted which would overload the pulling means 3. By appropriate means, such as the provision of two protrusions 15 on the rotatable rings 5 or respectively 13, which are arranged on separated circles, the angular position of the lid relative to the rotatable ring 5 or respectively 13 is defined.

Each the elevation of the bottom 10 in the can corresponds to a specific angular position of the rotatable ring 5. Since the lid 7 assumes a defined position relative to the rotatable ring 5, the position of the lid is an indication as to the elevation or position of the bottom 10. This is being utilized for a display of the filling situation of the can, wherein an indicator 18 on the lid 7 points toward a marking 19 on the outside of the can, on which the degree of filling of the can can be directly read.

The lid 7 has a cup-like indentation or has a filler element 21, the lower plane of which reaches down onto the contents. Thereby an additional reduction of the air volume above the contents is achieved.

The lid 7 is provided with a rim or collar 8. This rim has slots 22. Thereby the individual sections of the rim 8, which are formed by the slots 22, can be provided with some elastic force, which cause the lid 7 to be held on the can.

The lid 7 can be readily turned and can be removed by simple pulling.

The lower front side of the can, which is built substantially by the lower stationary ring 12, is provided with an opening, through which the air can escape during the descent of the bottom 10. The upward movement of the bottom, which occurs only after withdrawal of contents, is generally slow enough, so that excessive air can escape through the few leaks between the lid 7 and the can. Once the can is completely empty, i.e. the bottom 10 in its uppermost position, it is necessary for the refilling of the can to move the bottom back into its lowest position. For this purpose the lid 7 is placed onto the bottom of the can. By simple rotation of lid 7 which cooperates or engages with protrusions 15 of the lower rotatable ring 13, the bottom 10 is pulled down. Sealing lip 11 of the bottom 10 is directed upwardly and is not injured during this actuating or movement of the bottom 10. In addition to the sealing lip 11 a second sealing ring below the bottom 10 can be provided for.

What is claimed is:

1. A can comprising a body element and a lid closing one end thereof; and a bottom closing the other end thereof and being slidably arranged within said body element, said bottom, said body element and said lid defining a space for the contents of the can; and an actuator means attached to said bottom and arranged to slidably move said bottom axially within said body element, whereby to minimize the empty space between the contents and said lid, said actuator means being operatively associated with said lid, said association being such that upon rotation of said lid, the bottom is moved on the axis of the body element, said actuator means including a floating ring arranged to rotate in a plane normal to the direction of movement to the bottom; and pulling means attached to said bottom and to said floating ring, said attachment being such that by rotation of said lid said floating ring will rotate and cause an axial displacement of said bottom.

2. The can according to claim 1 further comprising a stationary ring attached to said body and supporting said floating ring, and wherein said pulling means includes at least three strings, and coupling means for coupling said lid and said floating ring to allow transmission of the rotational movement of said lid onto said floating ring.

3. The can according to claim 2 wherein said pulling means is formed by four strings.

4. The can according to claim 2 wherein said body has guides for guiding the pulling means inside of said body.

5. The can according to claim 4 wherein said pulling means are each of the same length and wherein each element of the pulling means is attached to said floating ring, said attachment of each element being axially offset with respect to the other of said elements; and wherein the azimuthal location of attachment of the other end of said elements is chosen to compensate for said axial offset of the attachment.

6. The can in accordance with claim 1 further including a lower actuator means whereby said bottom can be lowered in said body.

7. The can in accordance with claim 6 wherein said lower actuator means comprises a lower floating ring rotatably arranged with respect to said body in a plane substantially normal to the direction of movement of said bottom; and a lower pulling means attached to said bottom and to said lower floating ring such that rotation of said lower floating ring will cause axially displacement of said bottom inside of said body.

8. The can in accordance with claim 7 wherein said lower actuator means comprises a stationary ring attached to said body and supporting said lower floating ring; and said lower pulling means comprising at least three strings and coupling means, coupling said lid to said lower floating ring for transmission of a rotational movement of said lid onto said floating ring.

9. The can in accordance with claim 8 wherein said body has guides for guiding the lower pulling means.

10. The can in accordance with claim 1 wherein said floating ring and lid are provided with coupling elements for allowing the transmission of rotational movement of said lid onto said floating ring.

11. The can in accordance with claim 10 wherein said coupling element comprises at least two shallow ramps each with a steep end section at one end, said ramps being arranged at the top of said floating ring and at least two protrusions attached to said lid and arranged for engagement with said ramps so that the coupling between the rotational movement of the lid and the floating ring is accomplished only in one direction of movement of the lid, so that upon rotation of the lid, the bottom will be raised.

12. The can in accordance with claim 10 wherein said coupling elements are controlled by overload safety means preventing excessive pulling on said pulling means.

13. The can in accordance with claim 1 further comprising filling degree indicator means having an indicator and a marking, one of them being attached to the lid, the other being attached to the outside of the body of the can, said indicator pointing toward said marking.

14. The can in accordance with claim 1 wherein said bottom is provided with an upwardly directed sealing lid which engages the inside of said body.

15. The can in accordance with claim 1 wherein said lid has a lower plane formed by a cup-like indentation in the lid, which lower plane reaches into said space and onto the contents of said can.

16. The can in accordance with claim 1 wherein said lid has a separate filling element, which filling element reaches into said space and onto the contents of the can.

* * * * *